United States Patent [19]

Brieseck et al.

[11] Patent Number: 4,728,058

[45] Date of Patent: Mar. 1, 1988

[54] AIRBORNE BODY WITH OVER-CALIBER SIZED GUIDANCE MECHANISM

[75] Inventors: Bernd Brieseck, Henfenfeld; Josef Nagler, Rothenbach/Pegn., both of Fed. Rep. of Germany

[73] Assignee: Diehl GmbH & Co., Nuremberg, Fed. Rep. of Germany

[21] Appl. No.: 899,547

[22] Filed: Aug. 22, 1986

[51] Int. Cl.[4] ..... F42B 15/053

[52] U.S. Cl. ..... 244/3.28; 244/3.27

[58] Field of Search ..... 244/3.26–3.3, 244/49

[56] References Cited

U.S. PATENT DOCUMENTS

| | | | |
|---|---|---|---|
| 3,273,500 | 9/1966 | Kongolbeck | 244/3.28 |
| 3,643,599 | 2/1972 | Hubich | 244/3.27 |
| 3,695,556 | 10/1972 | Gauzza et al. | 244/3.28 |
| 3,790,104 | 2/1974 | Jones | 244/3.28 |

FOREIGN PATENT DOCUMENTS

| | | | |
|---|---|---|---|
| 3432614 | 3/1986 | Fed. Rep. of Germany | 244/3.28 |
| 3434879 | 4/1986 | Fed. Rep. of Germany | 244/3.28 |
| 1405380 | 5/1965 | France | 244/3.28 |

*Primary Examiner*—Deborah L. Kyle

*Assistant Examiner*—Michael J. Carone

*Attorney, Agent, or Firm*—Scully, Scott, Murphy & Presser

[57] ABSTRACT

An airborne body with an over-caliber sized guidance mechanism, especially a projectile with control surfaces, whose surfaces are retracted against a projectile tail structure prior to launching or firing of the projectile from a weapon barrel or tube, and are generally radially extended subsequent to exiting from the barrel. A securing or latching pin arrangement is provided between the tail end structure of the projectile and each control surface for maintaining the latter is a retracted position, and is released upon acceleration of the projectile after firing to allow for the outward extension of the control surfaces into their operative positions. In this connection, there is especially contemplated a projectile which is fireable from a mortar tube or other kind of weapon barrel, and which possesses guidance control surfaces in order to enable influencing a flight trajectory (such as, for instance, final flight-phase guidance). The airborne body can also relate to a projectile equipped with a rocket propulsion arrangement, and in which the guidance mechanism can pertain to aerodynamic stabilizer fins.

4 Claims, 1 Drawing Figure

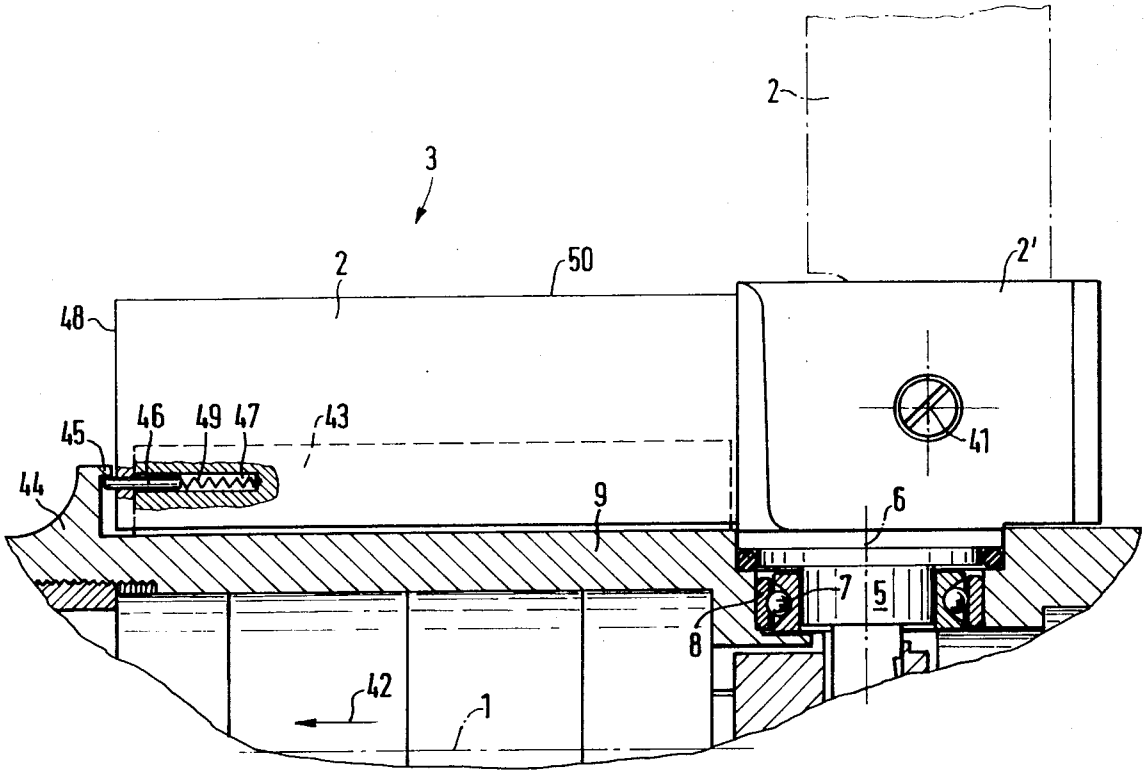
2'
41
2
6
5
7
8
50
9
3
1
2
43
42
47
49
46
48
45
44

AIRBORNE BODY WITH OVER-CALIBER SIZED GUIDANCE MECHANISM

BACKGROUND OF THE INVENTION

1. Field of the Invention

The present invention relates to an airborne body with an over-caliber sized guidance mechanism, especially a projectile with control surfaces, whose surfaces are retracted against a projectile tail structure prior to launching or firing of the projectile from a weapon barrel or tube, and are generally radially extended subsequent to exiting from the barrel. In this connection, there is especially contemplated a projectile which is fireable from a mortar tube or other kind of weapon barrel, and which possesses guidance control surfaces in order to enable influencing a flight trajectory (such as, for instance, final flight-phase guidance) wherein; however, the airborne body can relate to a projectile equipped with a rocket propulsion arrangement, and in which the guidance mechanism can pertain to aerodynamic stabilizer fins.

2. Discussion of the Prior Art

An airborne body in conformance with the foregoing concept is presently known from the disclosure of German Laid Open Patent Application No. 26 23 582. In that instance, provided in the region of the muzzle of the launch tube or barrel is a shoulder which reduces the size of the muzzle, which is engaged from behind by a projection during the exit of the projectile, and which, with a retracted control surface, protrudes radially from the control surface relative to the longitudinal axis of the projectile. When the projectile exits from the muzzle of the weapon barrel, through contact against the projection pivots the control surface which then is still retracted in the launching direction against the projectile fuselage, outwardly in front of the muzzle of the launch tube or barrel. However, it is of particular disadvantage in this arrangement that, for firing of the projectile, there is required a special configuration for the muzzle of the barrel in the shape of an inwardly corbeling shoulder; in essence, there cannot be found any utility for standard barrels or launch tubes which are usual for other projectiles. In addition thereto, also disadvantageous is the intense sudden impact-like introduction of force from the shoulder to the projection on the control surface, when this has displaced itself at the high starting acceleration from the stationary position of the projectile up to the muzzle of the barrel; with the consequence of a considerable danger of damage to the support for the control surface on the projectile, as well as to the muzzle of the barrel.

Finally, this already known mechanism is functionally restricted to that the control surfaces must be retracted against the projectile structure in parallel therewith forwardly in the starting direction; which represents a constructive restriction with respect to the configuration of the guidance mechanism and the tail end structure of the projectile, especially because of the relatively far rearwardly positioned extension axes for the control surfaces. Finally, it can also be viewed as being disadvantageous, that the retracted control surfaces are not fixed in a defined position in the barrel or launch tube nor even during the manipulation outside of a tube, which, however, would be desirable in the interest of operational and handling safety.

SUMMARY OF THE INVENTION

In recognition of these existent conditions, it is an object of the present invention to so equip an airborne body of the above-mentioned type, such that, at a constructive freedom of movement up to firing, there are obtained guidance mechanism surfaces held in an assured position, and a functionally-dependable release upon the start of the airborne body.

The foregoing object is achieved in an airborne body of the above-mentioned type in that there a securing or locking pin is provided between the tail end structure of the projectile and each control surface.

In accordance with the foregoing, for the caliber maintaining position of the guidance mechanism there is provided a form-fitting engagement between the control surface and the tail end structure of the airborne body, which is released due to inertial forces during the starting acceleration of the airborne body, and as a result allows for a movement into the over-caliber sized operational position. Hereby, relative to the starting direction, a locking pin can be arranged forwardly as well as rearwardly of an axis for the outward rotation or extension of a control surface, and for example, is spring-supported for exerting an elastic compression into the form-fitting secured or locked position of the control surface itself, as well as being supported on the tail end structure of the airborne body or projectile.

It is especially expedient, for a control surface which is retractable against the tail end structure in the starting direction about a rearwardly located pivot axis, to clamp the locking pin between the end surface of the control surface located in the starting direction and a radially projecting protuberance in front thereof which is attached to or formed on the tail end structure. Thus, on the one hand, because of the lengthy lever arm between the edge of the surface and the pivot axis of the control surface, there are obtained advantageous kinematic conditions for the latching of the control surface in the retracted position; whereas, on the other hand, the protuberance can then in an advantageous manner, be simultaneously formed as the frontal covering of a longitudinal groove provided in the mantle surface of the tail end structure, into which there immerses the caliber-maintaining retracted control surface, whereby its aerodynamically sensitive leading edge is well protected during storage in a supply magazine and during handling up to the start from the launch tube or barrel.

BRIEF DESCRIPTION OF THE DRAWINGS

Additional alternatives and modifications, as well as further features and advantages of the invention can now be readily ascertained from the following detailed description of a preferred embodiment of the invention, taken in conjunction with the accompanying single figure of the drawing illustrating a fragmentary, partly-sectioned view of a portion of the tail end structure of an airborne body having a control surface articulated thereto.

DETAILED DESCRIPTION

In the illustrated embodiment of an over-caliber sized guidance mechanism, there is ascertainable a control surface 2 in its operative position, and which is fastened to a control surface support 2', in essence, especially subsequent to the firing from a launch tube or barrel, oriented in the longitudinal axis 1 of the projectile, in order to be able to serve for the aerodynamic directional guidance of the projectile 3. As is more closely explained in detail for such a guidance arrangement in the U.S. Pat. No. 4,660,786, issuing April 28, 1987 and which is assigned to the assignee of the present invention, for this purpose, a support 5 which is pivotable about an axis of rotation 6 extending transversely of the longitudinal axis 1 of the projectile, is arranged in a bearing 7 whose outer race 8 is retained in the supporting tail end structure 9 of the projectile 3.

The dimension of the control surfaces 2 transversely of the longitudinal axis 1 of the structure is over-caliber sized in relation to the diameter of a launch tube or barrel 2 (not shown), into which there must extend at least a part of the tail end structure 9 of the projectile 3 for the build up of a gas pressure generated by a propellant charge for the start of the projectile. As a result thereof, each control surface 2 is hereby retractable against the tail end structure 9 by being pivotable about an axis 41 which extends traversely of the longitudinal axis 1, as well as transversely to the axis of rotation 6, in the starting direction 42 of the projectile, as illustrated in the drawing. In this retracted position, the applicable control surface 2 immerses into a groove 43 which is formed into the outer casing surface of the tail end structure 9 in parallel with the longitudinal axis 1, and which extends almost up to a protuberance 44 located in front thereof and projecting from the casing surface of the tail end structure 9. By means of this submersible control surface arrangement, in the caliber-maintaining position, notwithstanding a wide control surface 2, there is given a relatively small diameter; and the groove 43 provides a laterally lengthwise guidance for the thin control surfaces 2 which, otherwise, could be subjected to dislocating about the tail end structure 9 due to the buildup of the propellant gas pressure. The protuberance 44 which projects radially from the tail end structure 9, includes a form-fitting catch or detent 45 opening in parallel with the longitudinal axis 1 and facing in the direction towards the groove 43; for example, a blind bore, or simply a protruding edge, into which there projects a locking pin 46; for example, rearwardly of the caliber-maintaining control surface 2, in order to retain the control surface 2 in this retracted position. On the opposite side, the locking pin 46 engages into a bore 47 which extends in parallel with the longitudinal axis 1 and with regard to the longitudinal expanse of the control surface 2, which opens opposite the protuberance 44 in the end wall surface 48 of the control surface 2. Arranged in the bore 47, behind of the locking pin 46, is a spring 49 which elastically presses the locking pin 46 in the starting direction 42 against the protuberance 44 (namely, into the detent or catch 45). However, for the securing of this position for the pin 46, the latter can also be provided; for instance, with a collar-like encompassing snap ring.

Due to the firing acceleration in the launch tube or barrel, the locking pin 46 is displaced opposite the starting direction 42 (in effect, also opposite the compressive force of the spring 49, or for example, rupturing snap ring), so that it is released from the catch 45. The position of the axis 41 for the outward pivoting can be so selected relative to the geometric position of the center of gravity of th control surface 2, that the firing acceleration in the starting direction 42 causes a torque or turning moment to act on the control surface 2 about the pivoting axis 41, such that the control surface 2 which is no longer restrained by the locking pin 46 tends toward a lateral outward displacement. In addition thereto, or instead thereof, the support 42' can have a prestressed spring (not shown) built in, which transmit a torque or turning moment in the outwardly extending direction against the control surface 2, and thereby also serves in the caliber-maintaining or storaged position thereof for the radially form-fitting positioning of the pin 46 within the catch 45, as well as propagating the outward extension about the axis 41 after release of this latching engagement, when the tail end structure 9 has exited from the tube or barrel.

During this outward pivoting of the control surfaces 2 into their operational position (as illustrated in phantom-lines in the drawing), the locking pin 46 which, initially due to the firing acceleration is caused by inertial conditions to be further slid into the bore 47 in the control surface, is subjected to a centrifugal acceleration which, at times, can also be additionally supported by the force of a spring 49. Consequently, the no longer required locking pin 46 is expelled out of the end surface 48 of the control surface; when there is not provided any constructive latching arrangement (not shown) for securing the tube inlet from such a locking pin 46 which is expelled in this manner.

In contrast with the illustrated embodiment, the axis 41 can also possess a different orientation relative to the axis 1 of the structure; and, moreover, the geometric configuration of the caliber-maintaining retracted guidance mechanism-control surface 2 can be different; for example, it can evidence the configuration of a spirally-shaped band extending about the structure 9.

What is claimed is:

1. Airborne body comprising a projectile with a flight guidance mechanism which is over-caliber sized in the operative position of said mechanism, said guidance mechanism including extendable control surfaces, said control surfaces being retracted against a tail end structure of the projectile before firing of the projectile from a launch tube and substantially radially extended from said projectile subsequent to said projectile exiting from said launch tube; and locking pin means extending from intermediate the tail end structure and respectively to each of said control surfaces, said locking pin means engaging in a bore provided in an end surface of each said control surfaces and extending in the direction of travel of said projectile for maintaining said control surfaces in a caliber-maintaining retracted position of each said control surface; a protuberance extending radially outwardly from said tail end structure; a detent on said protuberance facing towards said bore; and resilient biasing means in said bore for biasing said locking pin means into latching contact with said detent prior to the firing of said projectile, said locking pin means being displaced into said bore opposite the resilient biasing means in response to acceleration force acting thereon upon firing of said projectile so as to cause said locking pin means to disengage from said detent and facilitate the outward extension of said control surfaces.

2. Airborne body as claimed in claim 1, wherein said locking pin means engage each said control surface in front of a pivoting axis for each said control surface on said tail end structure in the direction of travel of said projectile.

3. Airborne body as claimed in claim 1, wherein said locking pin means is displaceably arranged within said bore, and comprising means for exerting a form-fitting retention to said locking pin means.

4. Airborne body as claimed in claim 1, wherein a groove is formed on the outer surface of said projectile tail end structure so as to extend rearwardly of said protuberance along the longitudinal axis of said projectile for the receipt of respectively one of each said control surfaces in the caliber-maintaining retracted position thereof.

* * * * *